United States Patent [19]

Morera

[11] 4,128,241

[45] Dec. 5, 1978

[54] RACING BOARD GAME DEVICE

[76] Inventor: Gonzalo A. Morera, 903 Capri St., Coral Gables, Fla. 33125

[21] Appl. No.: 810,156

[22] Filed: Jun. 27, 1977

[51] Int. Cl.[2] ..... A63F 3/00

[52] U.S. Cl. ..... 273/246

[58] Field of Search ..... 273/134 CH, 134 CA, 273/134 AG, 134 DB, 134 ES, 134 CB, 246

[56] References Cited

U.S. PATENT DOCUMENTS

| | | | |
|---|---|---|---|
| 1,628,073 | 5/1927 | Sousa | 273/134 CH |
| 2,036,630 | 4/1936 | Hastings | 273/134 CH |
| 2,044,122 | 6/1936 | Michener | 273/134 CH |
| 3,057,623 | 10/1962 | Barnes | 273/134 CH |
| 3,690,666 | 9/1972 | Seitz | 273/134 CH |
| 3,883,143 | 5/1975 | Kelley et al. | 273/134 CH |

FOREIGN PATENT DOCUMENTS

| | | | |
|---|---|---|---|
| 548977 | 11/1942 | United Kingdom | 273/134 CH |
| 601939 | 5/1948 | United Kingdom | 273/134CH |
| 626731 | 7/1949 | United Kingdom | 273/134 CH |

*Primary Examiner*—Paul E. Shapiro
*Assistant Examiner*—Harry G. Strappello

[57] ABSTRACT

A game device including a gameboard having a main playing surface and a race track or pathway designated thereon comprising a plurality of zones progressively arranged along an elliptical pathway with indicia which designates a first entrance zone for a short race and a second entrance zone for a long race; the entrance zones are separated into segments and the game includes a plurality of play pieces each to be arranged at one of the segments of one of the entrance zones; one of the zones of the track or pathway is designated as a "Finish Line;" and, additionally, chance devices are provided in the form of a pair of dice, one of the dice being conventional and the other of the dice having a word thereon which indicates whether or not the number which shows on the conventional dice is to be the number of spaces moved, whether it is to be doubled, ignored, or the play piece is to be moved reversely.

4 Claims, 7 Drawing Figures

RACING BOARD GAME DEVICE

FIELD OF THE INVENTION

This invention relates generally to a gameboard type play device.

BACKGROUND OF THE INVENTION

In the past there have been numerous types of gameboards with a track or pathway along which play pieces are to be moved; and wherein dice are utilized to move play pieces along the track or path.

This invention is of an improved game wherein an elliptical path is provided on the main playing surface of a gameboard indicating a dog race course; and wherein play pieces are utilized and moved according to a novel chance means in the form of a pair of dice which are tossed together or simultaneously by a player. One of the dice indicates a number and the other of the dice indicates with respect to that number whether the play piece is to be advanced or moved reversely or, in some cases, remain in the same position. Indicia on the dice indicate whether the dog has been bumped, is running rapidly, is tired or is jumping. The players start at a designated point and move to a finish line. There are two starting zones which may be alternatively selected by the players for either a "long race" or a "short race."

OBJECTS OF THE INVENTION

It is an object of this invention to provide an improved game which resembles a dog race and which optionally provides for a short race or a long race and wherein competing players may participate. The chance devices which are utilized to move the play pieces are of a noval pair of dice, one of which indicates a number and the other of which introduces a second concept, namely, whether or not the number on the other of the dice is to indicate the actual number of spaces to be moved, is to be doubled, is to be reduced, or is to be ignored in accordance with the following specification, so as to resemble the various situations which occur in an actual dog race.

It is generally, an object of this invention to provide an improved dog racing game which is simple and inexpensive to manufacture and which provides a wide variety of moves for play pieces resembling a dog race.

In accordance with these and other objects which will become apparent hereinafter the instant invention will now be described with reference to the accompanying drawings in which:

DESCRIPTION OF THE PREFERRED EMBODIMENT

Figure 1:
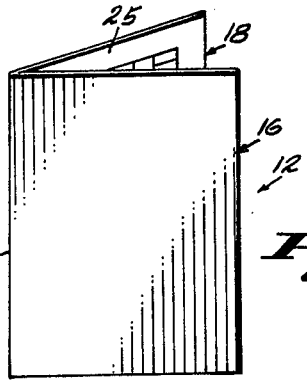
FIG. 1 is a perspective view of the gameboard in a folded condition.
Figure 2:
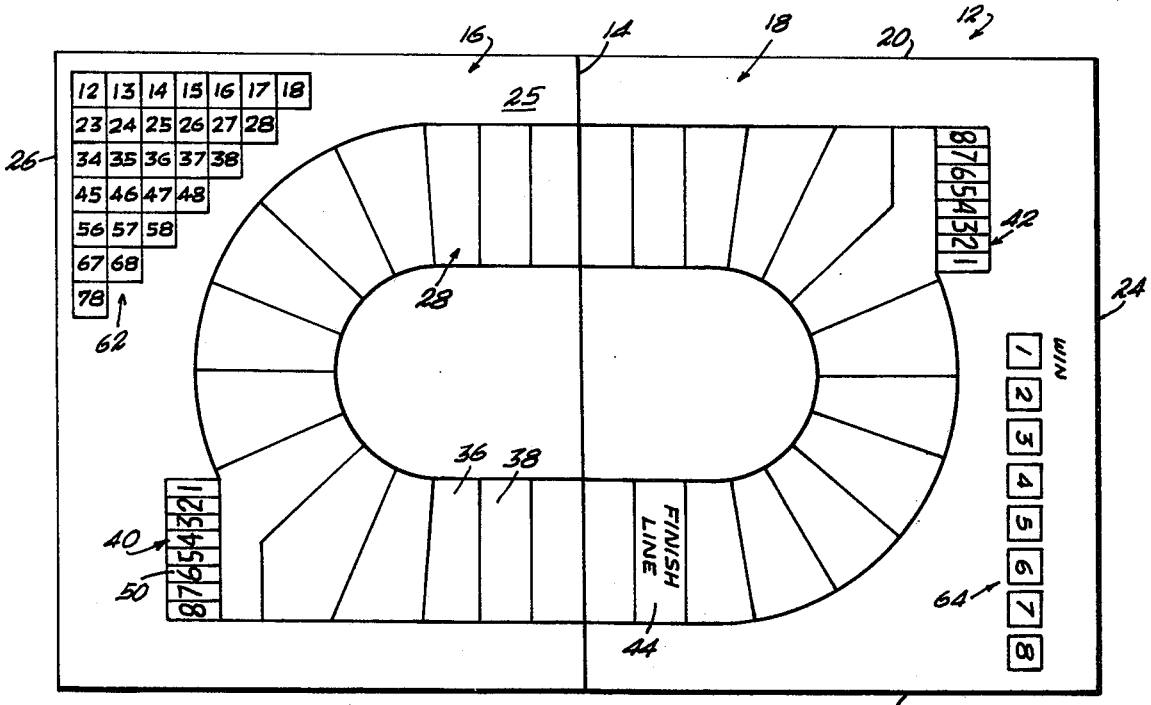
FIG. 2 is a plan view of the playing surface of the gameboard.

Referring to the drawings wherein like reference characters designate like or corresponding parts throughout the several views, the numeral 12 generally indicates a gameboard which is characterized by a fold line 14 so that it may be folded into the position shown in FIG. 1 for storage; or, alternatively, into the play position shown in FIG. 2. It is seen that there are two panels 16 and 18 on opposite sides of the fold line joined by two longitudinal edges 20 and 22 and two shorter edges 24 and 26. In the central region of the gameboard surface 25 there is a race track which is preferably elliptical and generally designated by the numeral 28 which is broken into a plurality of zones such as 36 and 38 which progressively form a pathway or track. At one corner zone of the track there is a first starting zone 40 which is designated and, at the opposite corner zone of the track, there is a second starting zone which is designated by the numeral 42.

Figure 3:
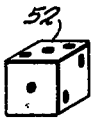
FIG. 3 is a perspective view of a chance device in the form of a die.
Figure 4:
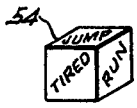
FIG. 4 is a chance device in the form of a separate cube.
Figure 5:
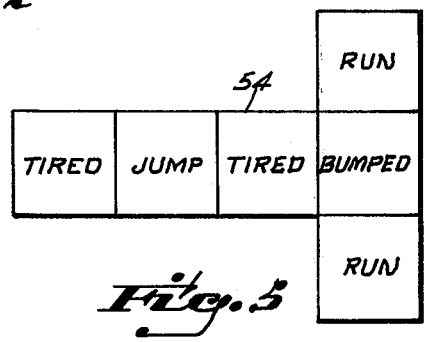
FIG. 5 is a folded out version of FIG. 4 illustrating the arrangement of the indicia on the chance device of FIG. 4.
Figure 6:
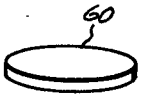
FIG. 6 is a perspective view of a play piece.
Figure 7:
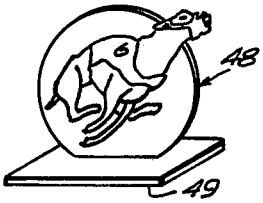
FIG. 7 is a view of the play piece which is moved in accordance with the chance device and the following description.

One of the zones, 44, is designated as the finish line. The play pieces, which resemble dogs in a preferred embodiment as shown in FIG. 7, 48, are moved according to the dictates of a chance device. Each player positions his play piece on one of the portions of the starting position 40 which corresponds to the number of his play piece. For example, the play piece shown in FIG. 7 and indicated by the numeral 48 is positioned on the space numbered 6 and designated by the numeral 50. The play pieces shown in FIG. 7 each have a base 49 which is sized to be received on one of the portions of the entrance zones. Thereafter, by throwing the dice, that is, both of the dice 52 and 54 simultaneously, a chance indication will be given, such as three dots on one of the dice and the word "Jump" on the other of the dice, see FIG. 3. This means that the dog designated by the numeral 6 is moved three places; and, because the "Jump" sign is up, he will move three additional spaces. If the dice shows the word "Run" then the dog is advanced the exact number of spaces on the dice. If, on the other hand, the word "Tired" comes up, the dog does not move at all. When the dice shows the word "Bumped" the dog goes backwards as many spaces as indicated on the other dice and, if necessary, he will go all the way back to the starting point. In the event that the player throws the dice three consecutive times; and each time the word "Bumped" comes up, his play piece is automatically eliminated from the game. The players using the play piece designated by the numeral 60 in FIG. 6 indicate whether they are playing to win or the "Perfecta," "Quiniela," etc. by positioning it in the correct places on the segments which are indicated on the left top as at 62 or the right bottom as at 64.

It is thus seen that there is provided a game which in use simulates a dog race which may be started either at the corner zone 40 or, optionally, at the corner zone 42 for either a short race or a long race.

What is claimed is:

1. A game device comprising a plurality of play pieces and a gameboard, said gameboard having a playing surface with an elliptical track defined thereon by indicia and which elliptical track is divided by lateral indicia into adjacent zones longitudinally arranged along the entire track, said track having corner zones and one of said corner zones of said track being designated a first entrance zone and at a diagonally opposite corner zone with respect to said one of said corner zones there being indicia designating a second entrance zone, each of said entrance zones being separated into a plurality of adjacent entrance zone portions, each of said entrance zone portions being sized to support respectively one of said plurality of play pieces, said game including chance device means, comprising a first conventional die with numerals 1 through 6 and a second die comprising a six-sided cube having an indicia on each main surface designating, respectively, the word "Run", "Tired", "Bumped ", and "Jump", and there being two designated "Run", two designated "Tired", and one designated "Jump" and one designated "Bumped", whereby when the die of the chance devices are thrown simultaneously, the conventional die indicates a number and the other die indicates whether or not the move is to be exactly as shown on the dice, is to be doubled, is to be ignored, or the play piece is to be moved reversely, each of said play pieces comprising member representing a dog, and one of said adjacent zones along said elliptical track spaced from said corner zones being designated "Finish Line".

2. The device as set forth in claim 1 wherein said play piece includes base means connecting said member, and said base having a surface corresponding in size to the portions of said entrance zones.

3. The device as set forth in claim 1 wherein said gameboard includes a fold line medially arranged across said gameboard for folding the gameboard in half for storage.

4. The game device as set forth in claim 1 wherein each of said entrance zone portions is provided with a separate indicia and each of said separate indicia is part of a series and each play piece is provided with an indicia corresponding to one of the indicia of said series.

* * * * *